US005555712A

United States Patent [19]

Nakade

[11] Patent Number: 5,555,712

[45] Date of Patent: Sep. 17, 1996

[54] METHOD FOR JUDGING THE QUALITY OF SLIVER IN TEXTILE MACHINE

[75] Inventor: Kazuhiko Nakade, Kyoto, Japan

[73] Assignee: Murata Kikai Kabushiki Kaisha, Kyoto, Japan

[21] Appl. No.: 336,221

[22] Filed: Nov. 7, 1994

[30] Foreign Application Priority Data

Nov. 10, 1993 [JP] Japan ..... 5-281513

[51] Int. Cl.[6] ..... D01H 7/46; D01H 7/92

[52] U.S. Cl. ..... 57/264; 57/265

[58] Field of Search ..... 57/264, 265

[56] References Cited

U.S. PATENT DOCUMENTS

| | | | |
|---|---|---|---|
| 5,046,013 | 9/1991 | Ueda et al. | 57/264 |
| 5,237,807 | 8/1993 | Iwade et al. | 57/264 |
| 5,347,449 | 9/1994 | Meyer et al. | 57/265 |
| 5,381,340 | 1/1995 | Ueda et al. | 57/264 X |

FOREIGN PATENT DOCUMENTS

| | | | |
|---|---|---|---|
| 541483 | 5/1993 | European Pat. Off. | 57/264 |
| 4-05086514 | 4/1993 | Japan | 57/265 |
| 2109020 | 5/1983 | United Kingdom | 57/264 |

*Primary Examiner*—William Stryjewski

*Attorney, Agent, or Firm*—Armstrong, Westerman, Hattori, McLeland & Naughton

[57] ABSTRACT

A sliver quality judging method in a textile machine which method can judge whether a spindle whose operating condition is bad is defective or not. Statistics are taken with respect to yarn quality information, including the breakage of yarn, uniformity, etc., for each spindle, then a spindle inferior in such yarn quality is picked out, and from the form of changes with time in the yarn quality information of that spindle there is made judgment whether the spindle is defective or sliver is of poor quality.

12 Claims, 9 Drawing Sheets

METHOD FOR JUDGING THE QUALITY OF SLIVER IN TEXTILE MACHINE

BACKGROUND OF THE INVENTION

1. Field of the Invention

The present invention relates to a method for controlling the operation of a sliver processing textile machine such as a spinning machine or the like. Particularly, the present invention is concerned with a method for judging the quality of sliver in a textile machine, the present method being capable of judging whether a spindle itself is defective or not, or which spindle is in a worse state of operation.

2. Prior Art

In a spinning machine for processing sliver into yarn, a single machine frame is provided with a large number of spindles (spinning units) for spinning. And each spindle is provided with a draft unit for drawing out sliver, a nozzle for spinning the drawn sliver into yarn, a take-up unit for winding the spun yarn to a package, and a yarn clearer for monitoring yarn, for example, detecting a yarn defect (slub) between the nozzle and the take-up unit.

Prior to the process of processing sliver into yarn there is a sliver producing process, and for the supply of sliver from the sliver producing equipment to the spinning machine there is used a cylindrical container, called a can. In an ordinary textile machine there is fed one can for each spindle, and a single replacement of a can permits the production of yarn over 2 to 3 days at the associated spindle.

In the spinning machine, the state of operation and the quality of yarn are detected with respect to each spindle and statistics are taken for the thus-detected information. For example, the number of times of stop is detected, and from the yarn thickness is detected the degree of change (uniformity) in yarn unevenness. The number of times of stop involves not only the number of times of stop based on full-loading or forced stop but also the number of times (or percentage) of slub breakage or of natural yarn breakage. Whether the operating condition of each spindle is good or bad can be judged from yarn quality information, including the breakage of yarn, uniformity, etc. As to a spindle involving bias in its yarn quality information, it can be estimated that there will be some defect. The number of times of slub breakage indicates how many times yarn has been cut with a cutter provided for each spindle in the event of occurrence of a yarn defect (e.g. nep, thin or thick).

The quality of yarn depends also on the quality of sliver as a feedstock. Therefore, when sliver of poor quality is fed, a bad result will appear also in the foregoing yarn quality information. In this case, even if a certain spindle is estimated to be defective on the basis of worsening of its yarn quality information and inspection and adjustment of the spindle are made, it will be impossible to find out any defect and no improvement will be recognized, that is, the work required for the inspection and adjustment becomes wasteful.

SUMMARY OF THE INVENTION

Accordingly, it is the object of the present invention to provide a method for judging the quality of sliver in a textile machine, the method being capable of solving the above-mentioned problem and judging whether there is any defect involved in a spindle whose operating condition is bad.

According to the present invention, in order to achieve the above-mentioned object, statistics are taken with respect to yarn quality information, including the breakage of yarn, uniformity, etc., for each spindle, then a spindle deteriorated in the quality of yarn is picked out, and from the form of change with time in yarn quality information of that spindle there is made a distinction as to whether the spindle is defective or whether the sliver is inferior.

In the above construction, by taking statistics of yarn quality information, including the breakage of yarn, uniformity, etc., for each spindle, there are obtained an average, dispersion and frequency distribution in the whole of the textile machine. For example, if in the frequency distribution there is any spindle standing out conspicuous in comparison with many other spindles, the said spindle is judged to be deteriorated in the quality of yarn, which deterioration is ascribable to some defect of the spindle or poor quality of the sliver.

Now, reference will be made here to the form of change with time in the yarn quality information. If any inferior point is recognized in the sliver being used and if the sliver used before the change to that sliver was of good quality, the yarn quality information varies greatly with the event of the sliver replacement as a boundary. When such inferior sliver has been consumed and replaced with a sliver of good quality, the yarn quality information will return to the original state. Thus, the change with time in the yarn quality information based on poor quality of sliver is characteristic in both abrupt change and duration of 2 to 3 days. On the other hand, in the case of occurrence of some defect on the spindle side, such change is gentler than in the case of poor quality of sliver; besides, since the change has nothing to do with the replacement of slivers it is irregular or continues even after the lapse of 3 days or more. Accordingly, from the form of change with time in the yarn quality information it is possible to make distinction as to whether a defect resides on the spindle side or on the sliver side.

DETAILED DESCRIPTION OF PREFERRED EMBODIMENT

An embodiment of the present invention will be described below in detail with reference to the accompanying drawings.

Figure 9:
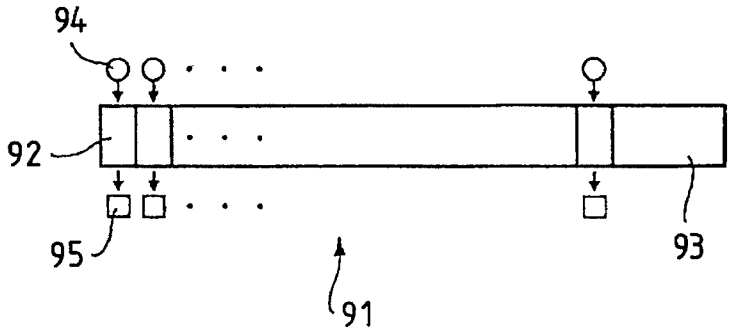
FIG. 9 is a conceptual diagram of a spinning machine.

As shown in FIG. 9, a spinning machine 91 has, say, 72 spindles each indicated at 92 and a control computer 93 for controlling those spindles together. Each spindle 92 processes sliver fed from a can 94 into yarn. Produced yarn 95 on each of spindles which have become full is doffed by means of a doffer (not shown). A can 94 which has become empty is replaced with a new one by means of a can changer (not shown). Each spindle 92 is provided with a yarn clearer (monitor) for monitoring yarn, and whether yarn is traveling or not, how thick the yarn is, whether the yarn has broken or has been cut, by what cause the yarn has been cut or broken, whether the spindle has become full, etc. are detected by means of the said yarn clearer. The results of such detection are fed continually to the control computer 93.

The control computer 93 totals such detection results at every predetermined time for each spindle and performs a statistical processing for the whole of the spinning machine. In this embodiment, one day is divided into two shifts, and the above totaling is conducted at every shift. The contents of the totaling for each spindle involve the number of times of stop classified by cause, the total number of times of stop and uniformity. As to the number of times of stop classified by cause, classification is made, for example, into stop caused by slub breakage, stop caused by red flag breakage (e.g. natural yarn breakage), stop caused by knot error, and doffing stop, and it is represented by the number of times per unit time. As to uniformity, it is represented in terms of U% or CV%. Given that an instantaneous value of yarn thickness is E, a time integral of a time mean value of E is A and a time integral of a deviation value (absolute value) of E from the time mean value is B, U% is represented as follows:

$$U\%=B/A\times 100$$

On the other hand, CV% represents a standard deviation obtained from changes with time of E. The thus-totaled information, including yarn breakage, uniformity, etc., is yarn quality information relating to the quality of yarn produced. The yarn quality information on each spindle at every shift is accumulated over a relatively long period (corresponding to a predetermined number of times of shift).

Figure 1A:
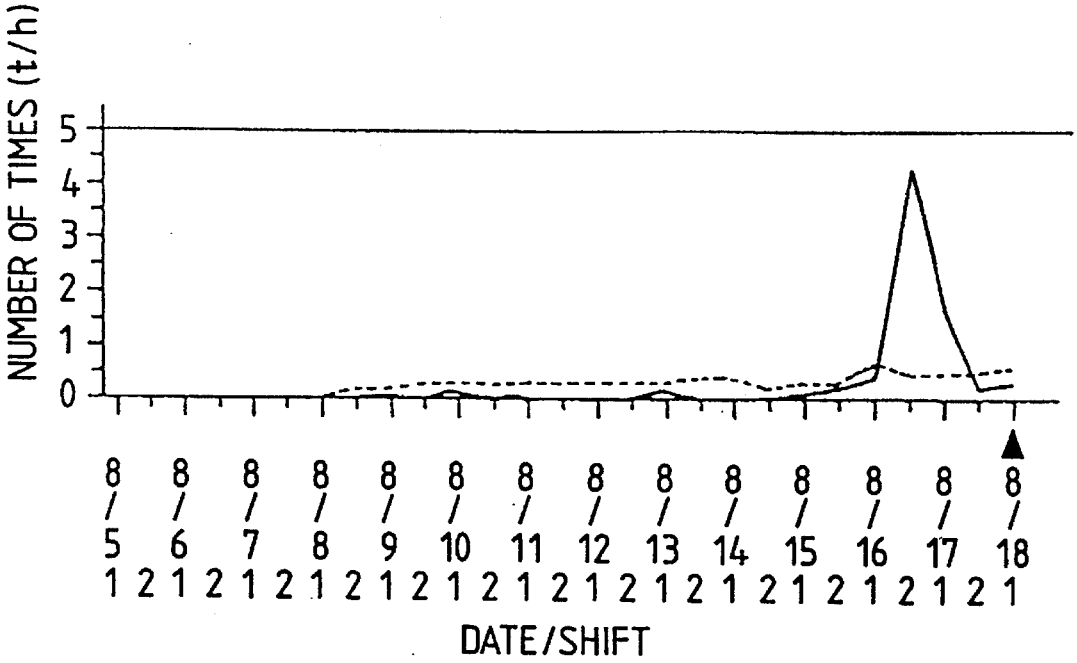
FIGS. 1A and 1B are graphs of broken lines obtained by connecting yarn quality information blocks of spindles in the order of time and which is used in the method of the present invention.
Figure 1B:
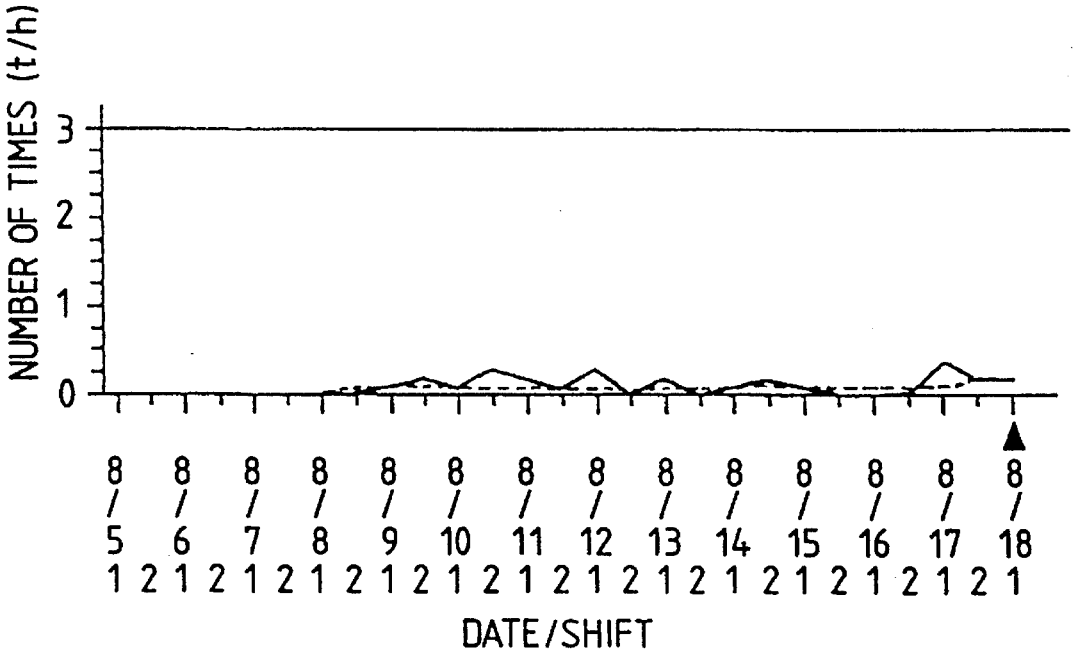
Figure 2A:
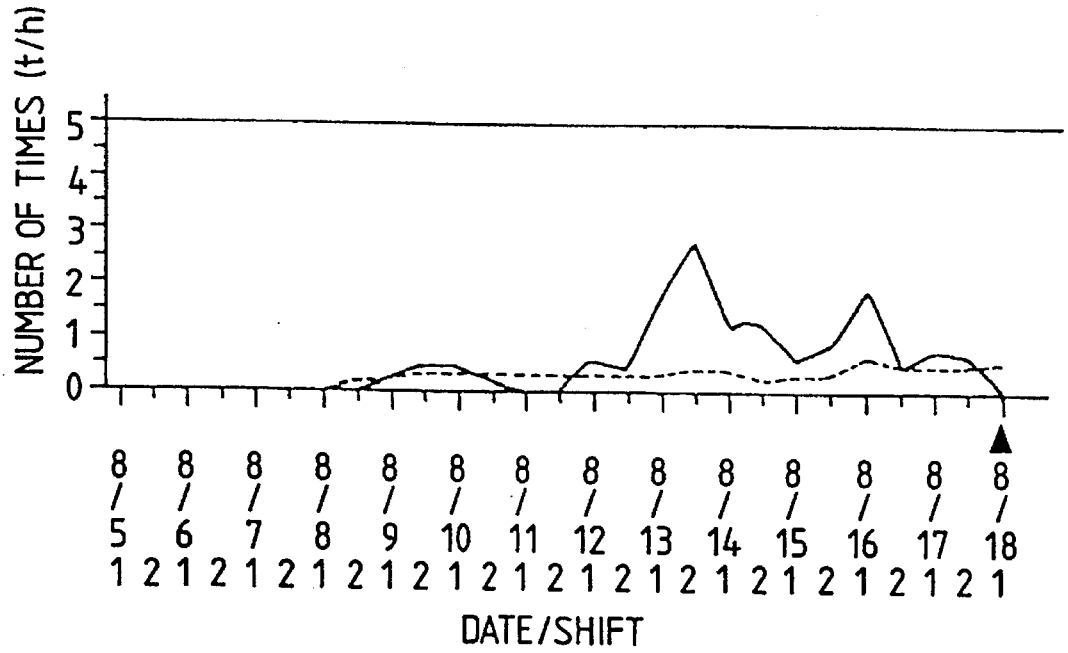
FIGS. 2A and 2B are graphs of broken lines obtained by connecting yarn quality information blocks of spindles in the order of time and which is used in the method of the present ivention.
Figure 2B:
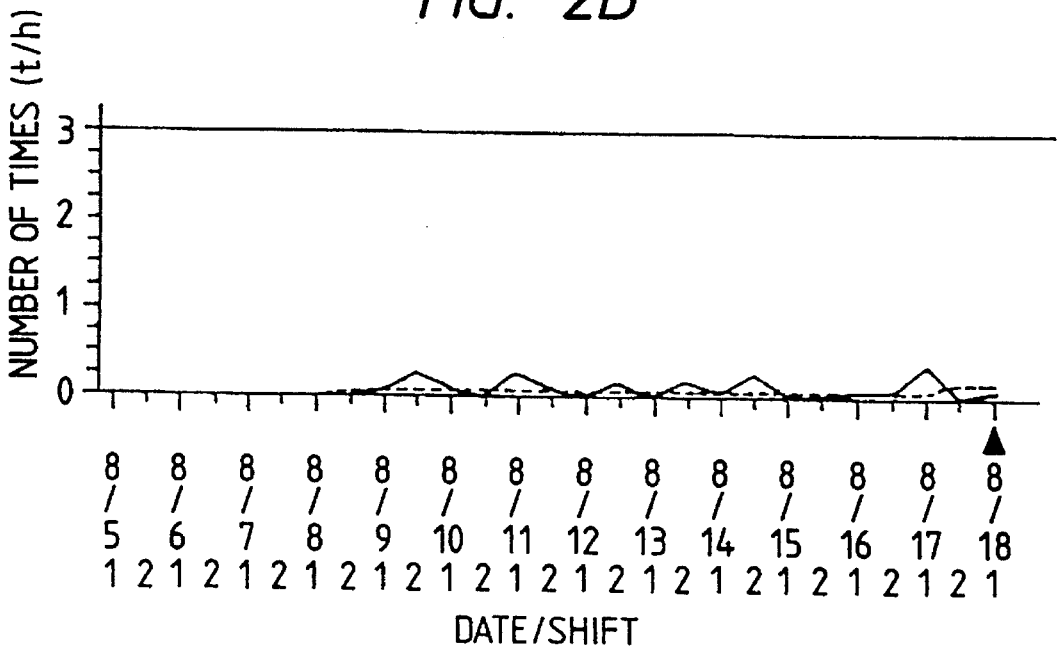
Figure 3A:
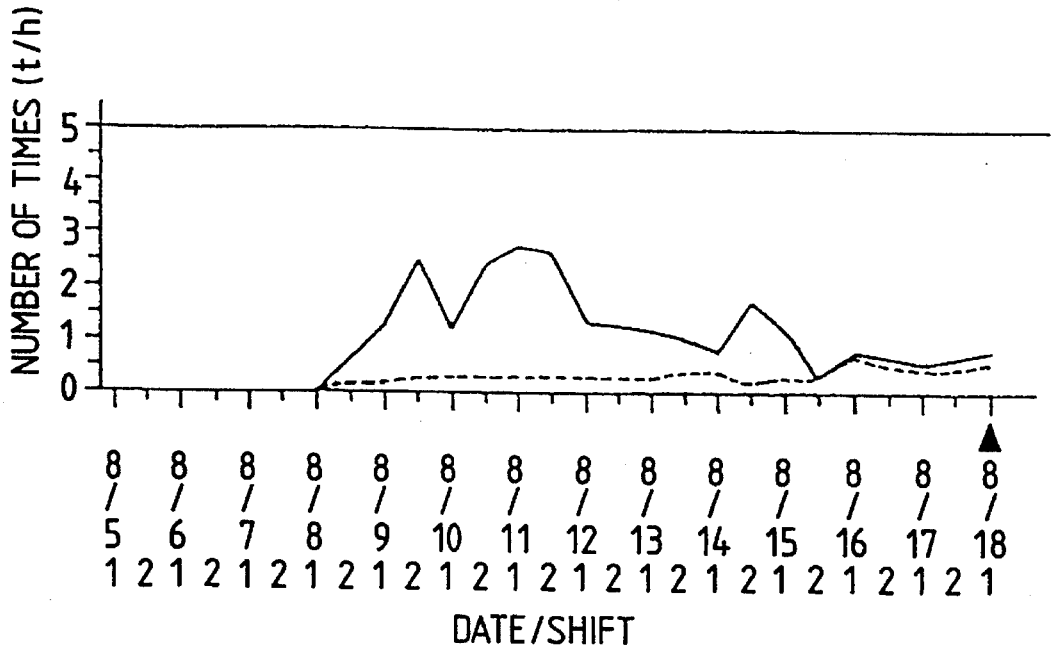
FIGS. 3A and 3B are graphs of broken lines obtained by connecting yarn quality information blocks of spindles in the order of time and which is used in the method of the present invention.
Figure 3B:
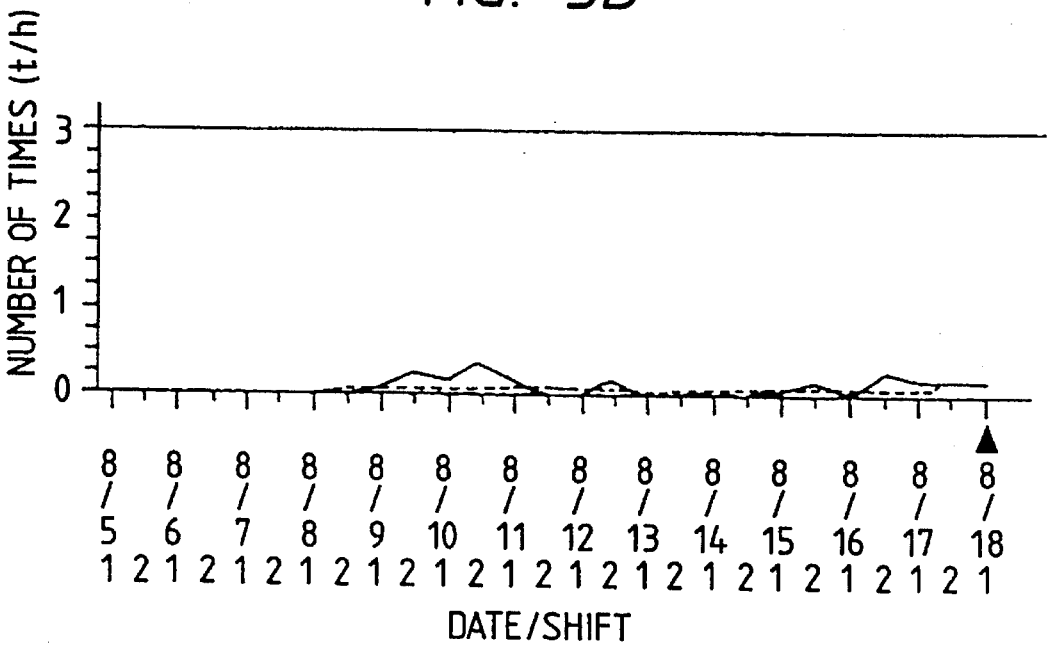

In order to check changes with time of such yarn quality information, the control computer 93 makes a trend graph, which graph is a graph of lines made by connecting yarn quality information blocks of arbitrarily selected spindles, as shown in FIGS. 1 to 3. By way of comparison, an average for the entire spinning machine is also shown in each of those figures using broken lines.

Figure 5A:
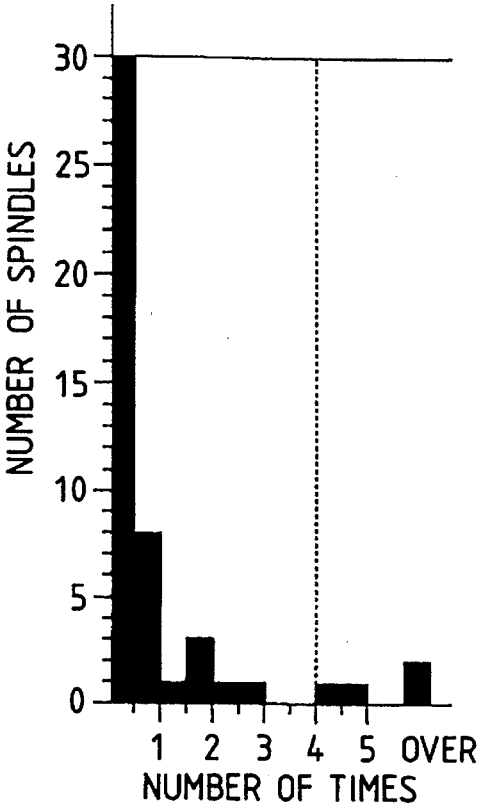
FIGS. 5A and 5B are bar graphs of frequency distribution used in the method of the present invention.
Figure 5B:
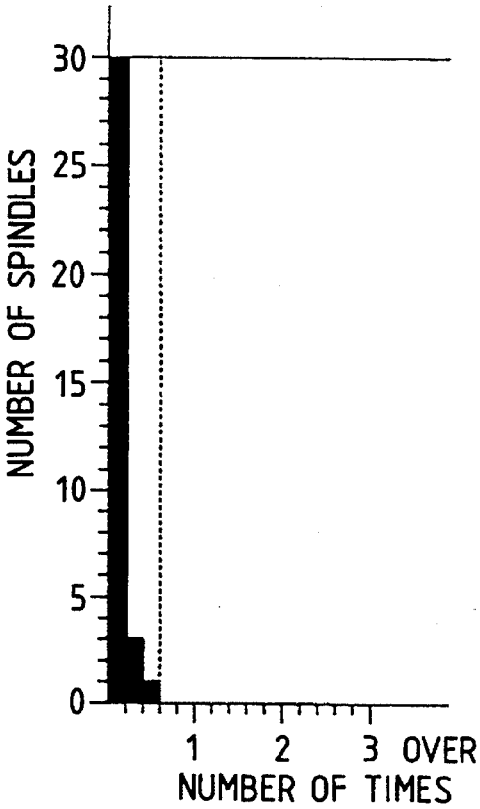
Figure 6A:
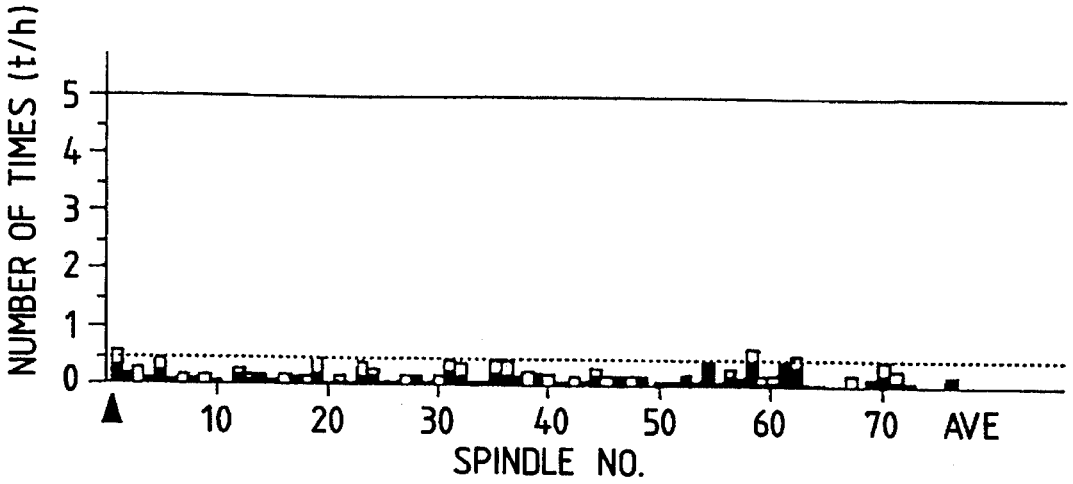
FIGS. 6A and 6B are bar graphs obtained by arranging the number of times of stop in the order of arrangement of spindles and which is used in the method of the present invention.
Figure 6B:
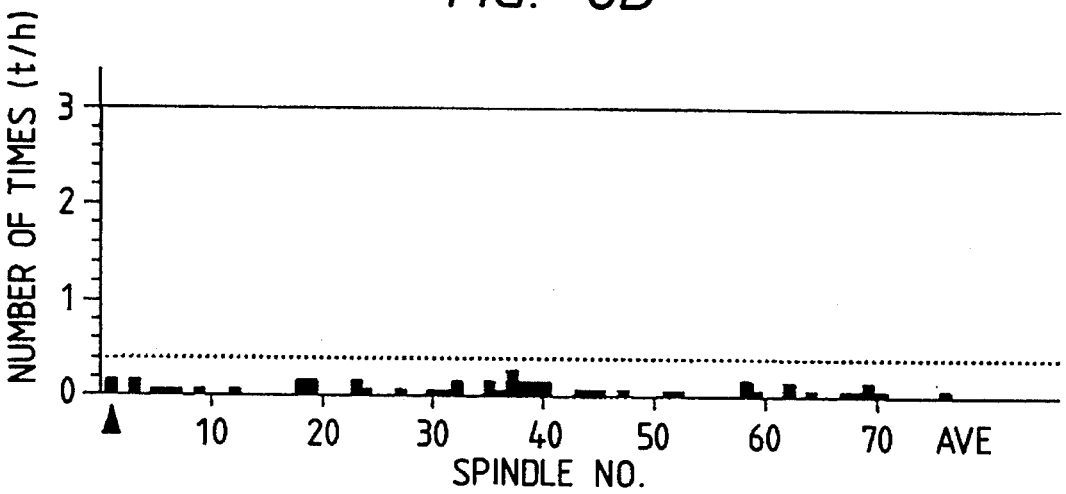

In this embodiment, the frequency distribution of yarn breakage classified by cause is used as a statistical processing for the entire spinning machine. FIGS. 4 and 6 are bar graphs in which stop frequencies (number of times) are arranged in the order of arrangement of spindles. The bar AVE represents an average. Frequency distributions based on the data shown in these graphs correspond to the bar graphs of FIGS. 5 and 7. As shown in the bar graphs of FIGS. 5 and 7, the frequency distributions are the results of having counted the number of spindles in the unit of 0.5 as stop frequency. The bar OVER represents the number of spindles exceeding a reference. The control computer 93 is provided with a display for the display of these graphs, etc.

Using the graphs obtained actually, the sliver quality judging method of the present invention will be explained below.

Figure 4A:
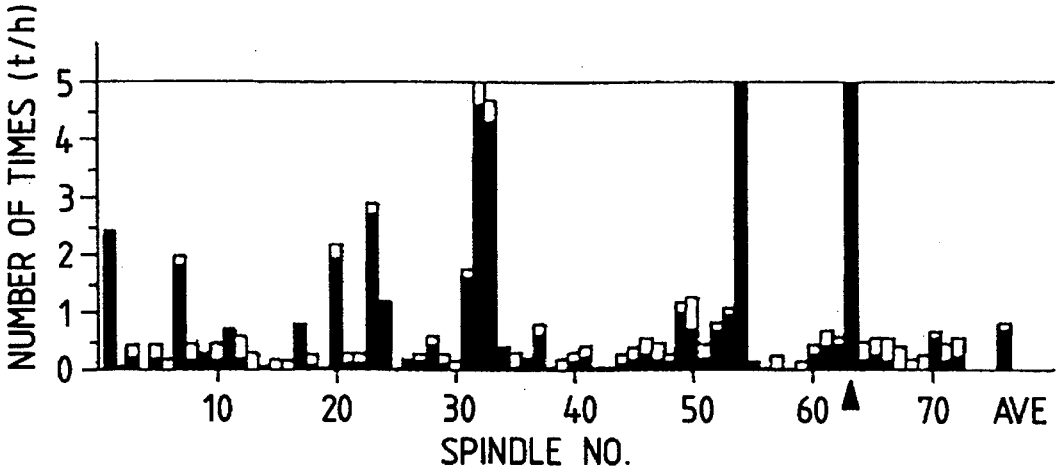
FIGS. 4A and 4B are bar graphs obtained by arranging the number of times of stop in the order of arrangement of spindle and which is used in the method of the present invention.
Figure 4B:
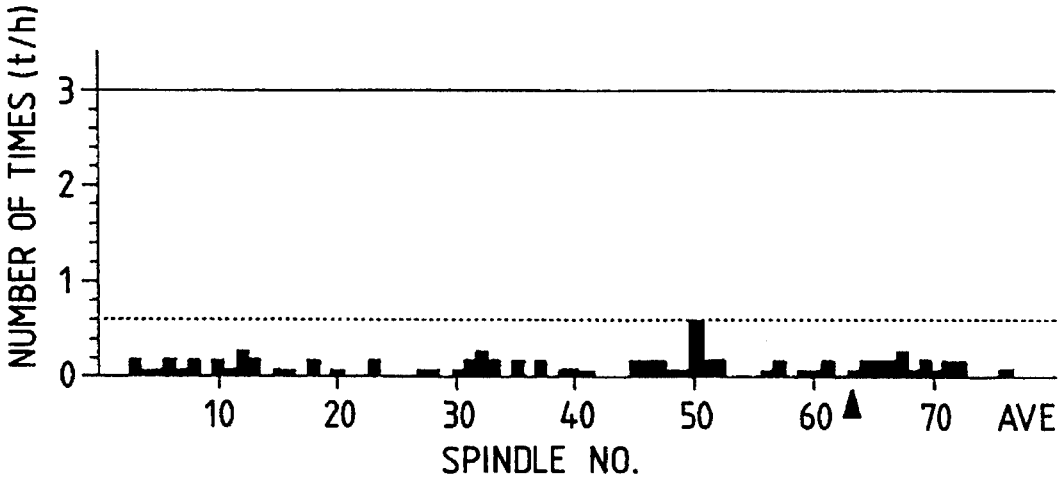

First, the graph shown in FIG. 4A is used which represents the total number of times of stop and the number of times of stop caused by slub breakage. In the graph of FIG. 4A, bars are darkened according to the number of times of stop caused by slub breakage, and the white bar portions each represent the number of times of stop based on any other cause. The graph of FIG. 4B is also a similar bar graph representing the number of times of stop caused by red flag breakage. (It means natural yarn breakage caused by clogging of a nozzle and the like.) From these graphs it is seen that the number of times of stop caused by slub breakage is extremely large at specific spindles. Next, there is used the graph of FIG. 5A which represents a frequency distribution with respect to the number of times of stop caused by slub breakage. From the graph of FIG. 5A it is seen that most spindles have stopped twice or less due to slub breakage and that in a somewhat spaced position there appear two spindles which have stopped four times or more. Since the criterion for judging bias in the number of times of stop caused by slub breakage is four times, it is judged that two spindles involve bias in their yarn quality information blocks. Such a bias is due to some defect of each spindle or due to poor quality of the sliver.

Reference will now be made to the form of changes with time in yarn quality information. With respect to one of the above two spindles, the trend graphs are referred to here. In each of FIGS. 1 to 3, the trend graphs have been obtained from different cases 1A, 2A, 3A being a trend graph representing the number of times of stop caused by slub breakage and 1B, 2B, 3B a trend graph representing the number of times of stop caused by red flag breakage at the same time as in 1A, 2A, 3A.

In FIG. 1A, the number of times of stop does not exceed "1" for a long time from August 8th on which the collection of data was started. But from the first shift made on August 16th it suddenly increased up to "4", then returned to the original state before the second shift made on August 17th. Only during the period presenting such a great increase the number of times of stop is above the average of the whole. This clearly means that the replacement of can was conducted on the occasion of the first shift made on August 16th and that sliver of poor quality was continued to be fed from the new can. Actually, the replacement of a can was conducted at that time point.

In FIG. 3A, the number of times of stop is many continuously from August 8th on which the collection of data was started; besides, it varies irregularly. Although a decrease is recognized in the latter half, the number of times of stop exceeds the entire average over the whole period. In this case, the changes are gentler than the changes based on inferior sliver mentioned above, and since increase and decrease are observed independently of the replacement of can, it can be judged that there is a defect on the spindle side.

In FIG. 2A, a relatively large increase is observed, but the continuing period of peaks based on such increase is judged to be 1 to 5 days, and thus it is not clear which of the sliver and the spindle is defective. However, since the variation is marked over the whole period, such as undulation for the entire average, it is very likely that there will be a defect on the spindle side.

Figure 7A:
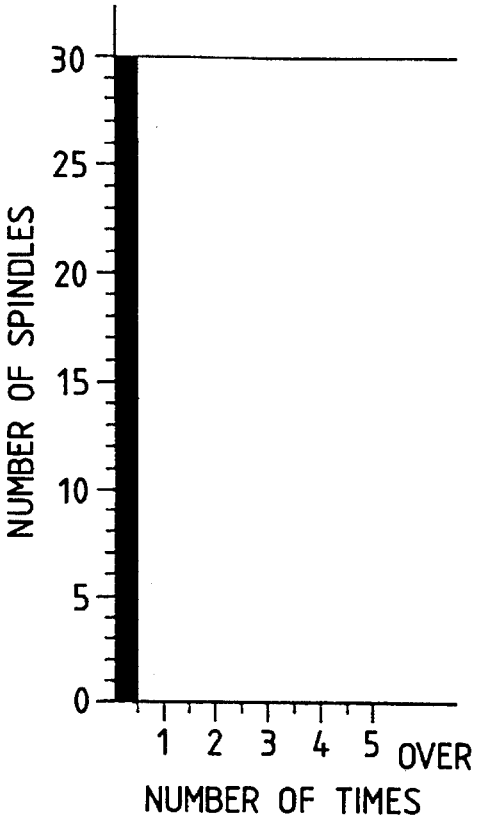
FIGS. 7A and 7B re bar graphs of frequency distribution used in the method of the present invention.
Figure 7B:
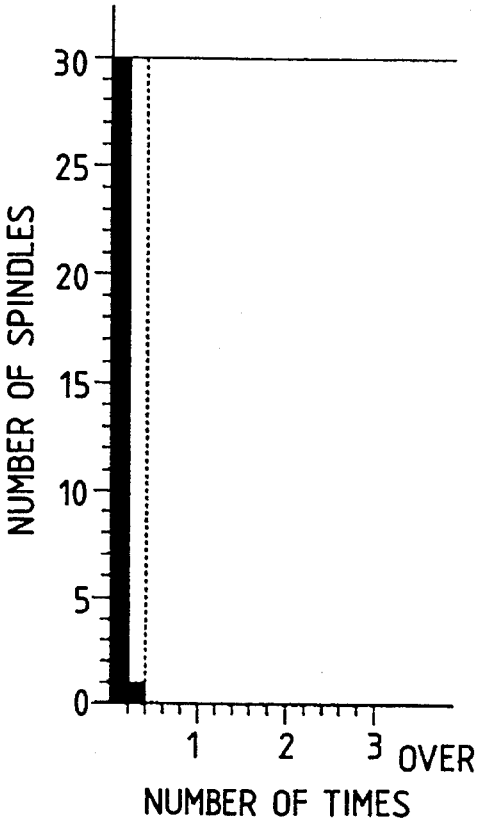

The bar graphs of FIGS. 6 and 7 have been obtained from the case where there is no bias in the yarn quality information of spindle. Upon a comparison of FIG. 6 with FIG. 4, it is seen that in FIG. 6 the total number of times of stop is smaller over all the spindles, and reference to FIG. 7 shows that there is no bias in the yarn quality information. In this case, it can be judged that there is not any problem neither on the spindle side nor on the sliver side.

Figure 10:
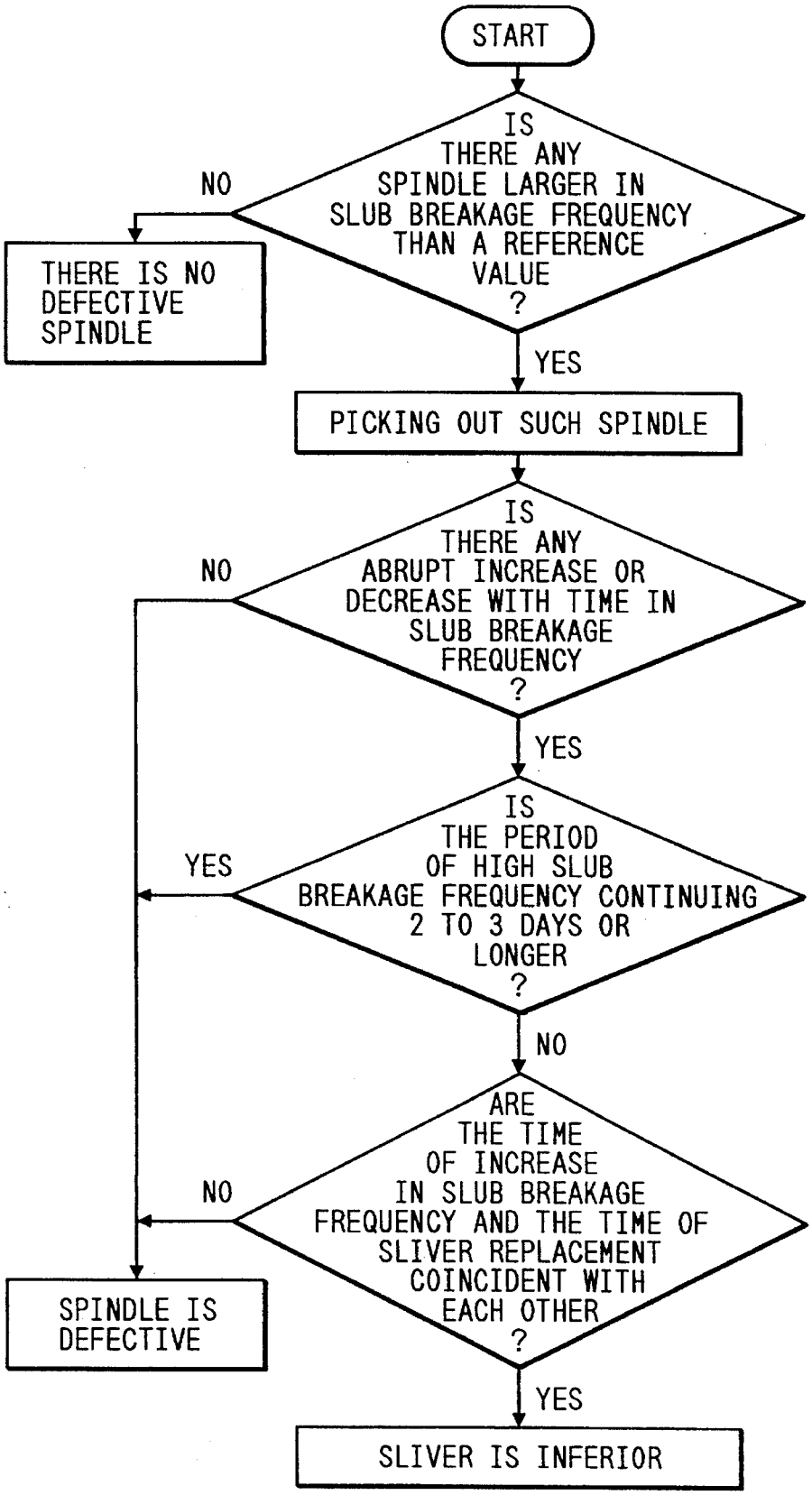
FIG. 10 is a flowchart of the sliver quality judging method acceding to the present invention.

FIG. 10 is a flowchart showing in what manner the quality judging method described above is carried out by the control computer. The same judgment as above is made by the computer and the results (Nos. of spindles inferior in yarn quality and the result of judgment regarding which of spindle and sliver is defective) are displayed on the display unit.

According to the present invention, as set forth above, whether a spindle is defective or the sliver is of poor quality can be judged from the form of changes with time in yarn quality information. Since it is possible to judge whether a spindle which is in a bad operating condition is defective or not, it is possible to form a proper judgment as to whether inspection and adjustment are to be conducted for that spindle. This also leads to judgment of the sliver quality from the yarn produced, and it also becomes possible to feed the information concerned back to the preceding process.

Although the method using the number of times of stop caused by yarn breakage has mainly been described as information for the judgment of yarn quality in the above embodiment, it goes without saying that, using U% or CV% each representing the uniformity of yarn, distinction may be made as to whether a spindle is defective or the sliver is of poor quality on the basis of the form of changes with time in U% or CV%.

In association with the judgment that the sliver is inferior, the event of can replacement has been determined from only the trend graph, but if there is adopted a construction wherein a signal indicative of the replacement of can is obtained from a can changer and the shift at which the replacement of can has been performed is shown on the trend graph, there will be attained a more accurate judgment.

Next, an application example of the present invention will be described below.

Figure 8A:
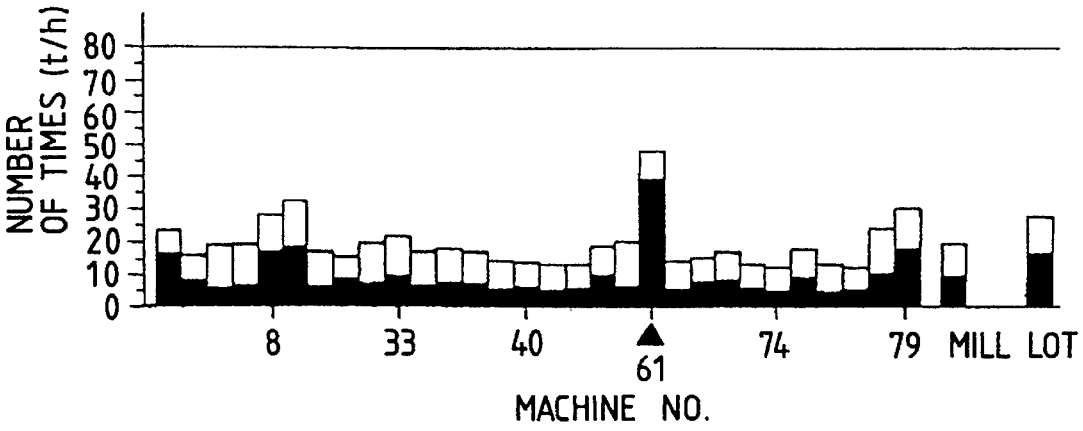
FIGS. 8A and 8B are graphs representing the number of times of stop in each machine according to an application example of the present invention.
Figure 8B:
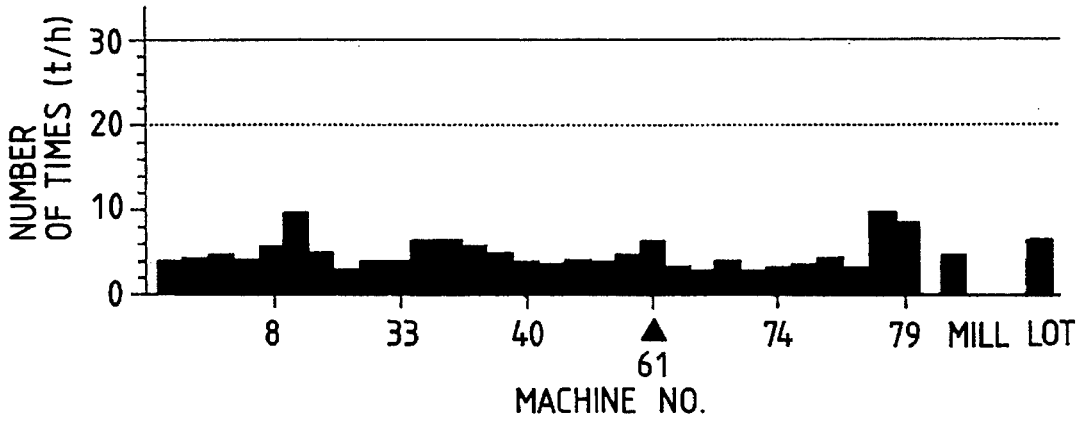

In connection with a system using a large number of the spinning machines 91 described in the above embodiment and wherein the yarn quality information from each machine is controlled synthetically by a host control unit, FIG. 8A is a bar graph representing the total number of times of stop in each machine and that caused by slub breakage (dark portions) and FIG. 8B is also a bar graph representing the number of times of stop caused by red flag breakage in each machine. The host control unit detects that there is some trouble in the machine of No. 61. In this case, the method of the present invention may be applied as in the above embodiment for the trouble-detected machine. The sliver referred to above also includes such a sliver as that fed to a ring spinning frame.

The present invention exhibits the following excellent effects.

(1) Since it is possible to determine whether a spindle whose operating condition is bad is defective or not, it is possible to judge correctly whether inspection and adjustment of the spindle are to be performed or not, that is, the time and labor for the inspection and adjustment never become wasteful.

(2) An inferior point incapable of being detected in the sliver producing process can be detected from the quality of yarn, and this information can be fed back to the sliver producing process.

What is claimed is:

1. A method for judging the quality of sliver in a textile machine, comprising the steps of:

(a) processing sliver into yarn in a textile machine having a multitude of spindles for processing sliver into yarn;

(b) monitoring the yarn with a monitor for monitoring yarn;

(c) providing a control computer for judging yarn quality;

(d) feeding results of the monitor to the control computer;

(e) causing the control computer to totalize the results of the monitor at predetermined times and take statistics with respect to yarn quality for each spindle;

(f) causing the control computer to, on the basis of changes with time of the yarn quality for each spindle, make a judgement as to whether one of the spindles is defective or whether the respective sliver is inferior; and (g) when the judgement is that the spindle is defective, conducting inspection and adjustment of the spindle to effect the quality of the yarn produced.

2. The method of claim 1, wherein in step (f) the judgement is made as follows:

the spindle is judged to be defective if the there is no abrupt change with time in the yarn quality and if a period of deterioration in the yarn quality continues over a predetermined period which corresponds to a length of time a can for supplying sliver from a sliver producing equipment permits the production of yarn.

3. The method of claim 1, wherein in step (f) the judgement is made as follows:

determining if there is any spindle larger in breakage frequency than a reference value, then if such a spindle is found:

(a) determining if there is any abrupt increase or decrease with time in breakage frequency;

(b) determining if a period of high breakage frequency continues for longer than a length of time a can for supplying sliver from a sliver producing equipment permits the production of yarn;

(c) determining if a time of increase in breakage frequency and a time of sliver replacement are coincident with each other; and the determination including if (a) is determined to be YES, (b) is determined to be NO, and (c) is determined to be YES, judging that the sliver is inferior.

4. The method of claim 1, wherein in step (f) the judgement is made by making a comparison between a time when the yarn quality deteriorates and a time when the replacement of sliver is performed.

5. The method of claim 1, wherein when the judgement is that the sliver is defective operation is continued without inspection and adjustment of the spindle.

6. The method of claim 1, wherein when the judgement is that the sliver is defective, information of the inferior sliver is be fed back to the sliver producing process so as to identify defects in the sliver producing process.

7. A method for judging the quality of sliver in a textile machine, comprising the steps of:

(a) processing sliver into yarn in textile machine with a multitude of spindles arranged for processing sliver into yarn;

(b) monitoring yarn with a means for monitoring yarn over time and for judging yarn quality based on monitored results;

(c) causing said means to take statistics with respect to yarn quality monitored, the yarn quality monitored being selected from the group consisting of breakage of yarn and uniformity for each spindle;

(d) causing said means to pick out a spindle inferior in the yarn quality;

(e) causing said means to, on the basis of changes with time of the yarn quality for each spindle, make a judgement as to whether the spindle is defective or whether the respective sliver is inferior; and (f) when the judgement is that the spindle is defective, conducting inspection and adjustment of the spindle to effect the quality of the yarn produced.

8. The method of claim 7, wherein in said step (e) the spindle is judged to be defective if there is no abrupt change with time in the yarn quality.

9. The method of claim 7, wherein in said step (e) the spindle is judged to be defective if a period of deterioration in the yarn quality continues over a predetermined period.

10. The method of claim 9, wherein the predetermined period is a duration of 2 to 3 days, which corresponds to a length of time a can for supplying sliver from a sliver producing equipment permits the production of yarn.

11. The method of claim 7, wherein in step (e) the judgement is made by making a comparison between a time when the yarn quality deteriorates and a time when the replacement of sliver is performed.

12. The method of claim 7, wherein in step (e) the judgement is made as follows:

the spindle is judged to be defective if the there is no abrupt change with time in the yarn quality and if a period of deterioration in the yarn quality continues over a predetermined period which corresponds to a length of time a can for supplying sliver from a sliver producing equipment permits the production of yarn.

* * * * *